US010218101B2

(12) United States Patent
Grzywok et al.

(10) Patent No.: US 10,218,101 B2
(45) Date of Patent: Feb. 26, 2019

(54) ELECTRICAL CONTACT UNIT AND ELECTRICAL WELDED JOINT AS WELL AS METHOD FOR PRODUCING A CONTACT UNIT AND FOR CONFIGURING A WELDED JOINT

(71) Applicant: TE Connectivity Germany GmbH, Bensheim (DE)

(72) Inventors: Wilhelm Grzywok, Munich (DE); Uwe Hauck, Kleinmanchow (DE); Andre Martin Dressel, Lampertsheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/386,142

(22) Filed: Dec. 21, 2016

(65) Prior Publication Data

US 2017/0104287 A1 Apr. 13, 2017

Related U.S. Application Data

(63) Continuation of application No. PCT/EP2015/064876, filed on Jun. 30, 2015.

(30) Foreign Application Priority Data

Jul. 1, 2014 (DE) ..... 10 2014 109 173

(51) Int. Cl.
*H01R 13/03* (2006.01)
*H01R 43/02* (2006.01)
(Continued)

(52) U.S. Cl.
CPC ..... *H01R 13/03* (2013.01); *H01R 4/029* (2013.01); *H01R 43/0221* (2013.01);
(Continued)

(58) Field of Classification Search
CPC ..... H01R 13/03
(Continued)

(56) References Cited

U.S. PATENT DOCUMENTS 1,073,670 A * 9/1913 Ford ..... H01R 11/24 429/160
1,560,308 A * 11/1925 Perry ..... H01H 1/5822 200/244
(Continued)

FOREIGN PATENT DOCUMENTS

CN 202259705 U 5/2012
DE 102013008497 A1 3/2014
(Continued)

OTHER PUBLICATIONS

German Office Action, dated Mar. 26, 2015, 5 pages.
(Continued)

*Primary Examiner* — Alexander Gilman
(74) *Attorney, Agent, or Firm* — Barley Snyder

(57) ABSTRACT

A contact of an electrical connector is disclosed. The contact comprises a surface having a surface cross-sectional thickness and a groove formed in the surface having a welded cross-sectional thickness less than the surface cross-sectional thickness. The contact is welded to a mating contact of a mating electrical connector at the groove.

19 Claims, 4 Drawing Sheets

(51) Int. Cl.
*H01R 4/02* (2006.01)
*H01R 11/11* (2006.01)
*H01R 11/28* (2006.01)

(52) U.S. Cl.
CPC ..... *H01R 4/023* (2013.01); *H01R 11/11* (2013.01); *H01R 11/288* (2013.01)

(58) Field of Classification Search
USPC ..... 439/874
See application file for complete search history.

(56) References Cited

U.S. PATENT DOCUMENTS 3,173,991 A * 3/1965 Breakfield, Sr. ..... H01B 7/08 156/252
3,864,008 A * 2/1975 Bakermans ..... H01R 4/185 206/343
3,945,709 A * 3/1976 Filson ..... H01R 4/48 439/860
4,315,175 A * 2/1982 Hamilton ..... H01R 4/029 174/90
4,583,065 A * 4/1986 Favre-Tissot ..... H01R 43/04 335/106
4,692,121 A * 9/1987 Arbogast, Jr. ..... H01R 4/027 29/874
4,834,682 A * 5/1989 Auclair ..... H01R 4/06 439/883
4,973,370 A * 11/1990 Kreinberg ..... H01R 4/2495 156/50
5,045,641 A * 9/1991 Urushibata ..... H01R 12/61 174/71 R
5,163,221 A * 11/1992 Favre-Tissot ..... H01H 1/5822 174/94 R
5,541,365 A * 7/1996 Sugiura ..... B23K 26/06 174/94 R
5,541,380 A * 7/1996 Ogden ..... H01R 11/12 219/56
5,724,730 A * 3/1998 Tanaka ..... B29C 45/14639 174/76
5,780,774 A * 7/1998 Ichikawa ..... H01R 12/61 174/117 FF
D400,169 S * 10/1998 Endo ..... D13/120
5,944,553 A * 8/1999 Yasui ..... B60R 16/0215 439/492
6,547,606 B1 * 4/2003 Johnston ..... H01R 12/61 174/88 R
6,576,842 B2 * 6/2003 Ishii ..... H01R 43/0207 174/84 R
6,598,293 B1 * 7/2003 Ide ..... H01R 9/0509 174/74 R
6,759,594 B2 * 7/2004 Iijima ..... G01P 1/026 174/135
6,761,598 B2 * 7/2004 Onizuka ..... H01R 9/2458 439/876
7,128,620 B2 * 10/2006 Maura ..... H01H 1/5822 439/874
7,128,621 B2 * 10/2006 Onose ..... H01R 43/0228 439/874
7,374,466 B2 * 5/2008 Onuma ..... H01R 11/28 439/874
7,524,207 B2 * 4/2009 Honda ..... H01R 23/70 439/570
7,591,696 B1 * 9/2009 Munn ..... H01R 4/64 439/883
8,430,699 B2 * 4/2013 Ishida ..... H01R 4/029 439/874
8,574,008 B2 * 11/2013 Gro.beta.e ..... H01M 2/202 439/627
8,784,119 B2 * 7/2014 Tseng ..... H01R 12/63 439/495
9,035,200 B2 * 5/2015 Kato ..... H02G 15/02 174/359
9,537,264 B2 * 1/2017 Wang ..... H01R 13/6597
2015/0079456 A1 * 3/2015 Pauleser ..... H01M 2/206 429/160

FOREIGN PATENT DOCUMENTS

JP H10334958 A 12/1998
JP 3410590 B2 3/2003
WO 2013131607 A1 9/2013

OTHER PUBLICATIONS

Abstract of DE 10 2013 008 497, dated Mar. 20, 2014, 1 page.
Chinese First Office Action and English translation, dated Apr. 2, 2018, 23 pages.
Abstract of JPH09108874A, corresponds to JP3410590B2, dated Apr. 28, 1997, 1 page.
Abstract of CN202259705, dated May 30, 2012, 1 page.
Abstract of JPH10334958A, dated Dec. 18, 1998, 1 page.
Notification, International Preliminary Report on Patentability and Written Opinion of the International Searching Authority, dated Jan. 3, 2017, 7 pages.
Japanese First Office Action and English translation, dated Apr. 2, 2018, 22 pages.
Chinese Second Office Action, Application No. 2015800369536, dated Nov. 16, 2018, 19 pages.

* cited by examiner

ELECTRICAL CONTACT UNIT AND ELECTRICAL WELDED JOINT AS WELL AS METHOD FOR PRODUCING A CONTACT UNIT AND FOR CONFIGURING A WELDED JOINT

CROSS-REFERENCE TO RELATED APPLICATIONS

This application is a continuation of PCT International Application No. PCT/EP2015/064876, filed on Jun. 30, 2015, which claims priority under 35 U.S.C. § 119 to German Patent Application No. 102014109173.6, filed on Jul. 1, 2014.

FIELD OF THE INVENTION

The present invention relates to an electrical contact of an electrical connector, and more particularly, to an electrical contact welded to a mating electrical connector.

BACKGROUND

Electrical connectors which transmit electric currents and voltages in the medium-current or high-current and/or medium-voltage or high-voltage range are known. In certain applications, such connectors must ensure, permanently or temporarily, problem-free transmission of electric power for example in warm, possibly hot, uncontaminated, humid and/or chemically aggressive environments. Electrical connectors or the electrical contacts thereof can be installed on an electrical device, for example, on a busbar, in a battery or a rechargeable battery, in an inverter, or in a switchgear assembly in automotive applications. Electric or hybrid vehicles handle high electric operating currents and/or voltages, wherein the relevant components of the vehicles need to be designed accordingly, requiring high-current/high-voltage connectors.

Laser welding of a contact of an electrical connector to a mating contact has certain limitations in the prior art related to the welded cross-sections of each contact. For example, in laser welding of a compacted section of a copper braided wire of the electrical connector to the mating contact, the mating contact should be approximately 50% thicker than the compacted section of the electrical connector in order to effectively exclude the possibility of welding through the mating contact. That is, a thickness ratio of 1:1.5 is used for laser welding the compacted section of the electrical connector to the mating contact. It is thus not possible in the prior art to weld a contact of an electrical connector to an already fitted mating contact which is slightly thinner, the same thickness or even slightly thicker than the contact.

SUMMARY

An object of the invention, among others, is to provide an electrical contact capable of forming an improved welded connection. The disclosed contact comprises a surface having a surface cross-sectional thickness and a groove formed in the surface having a welded cross-sectional thickness less than the surface cross-sectional thickness. The contact is welded to a mating contact of a mating electrical connector at the groove.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of an electrical connector. This invention may, however, be embodied in many different forms and should not be construed as limited to the embodiments set forth herein; rather, these embodiments are provided so that this disclosure will be thorough and complete and still fully convey the scope of the invention to those skilled in the art.

An electrical connector 1 according to the invention is shown in FIGS. 1-5. In the shown embodiment, the connector 1 is an electrical cable 1 in the form of a braided wire 1, which electrical cable is in the form of a module connector 1. The invention is not restricted to these embodiments, but applies to any electrical connectors used in medium-current or high-current and/or medium-voltage or high-voltage range applications, for example, cable harnesses, braided cables, litz wire cables, connections, connection devices, connection apparatuses, and other forms of electrical connectors known to those with ordinary skill in the art.

Figure 1:
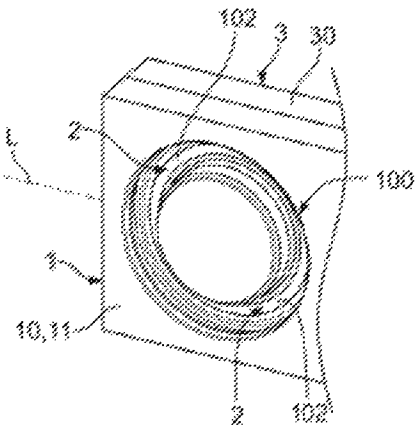
FIG. 1 is a perspective view of a contact of an electrical connector according to the invention.

The electrical connector 1, as shown in FIG. 1, has an electrically conductive contact 10 which can be connected to an electrically conductive mating contact 30 of a mating electrical connector 3 by an electrically conductive welded connection 2. In the embodiment shown in FIGS. 1 and 2, the contact 10 is in the form of a compacted section of the cable 1. The contact 10 may be crystalline, homogeneous and/or amorphous.

Figure 2:
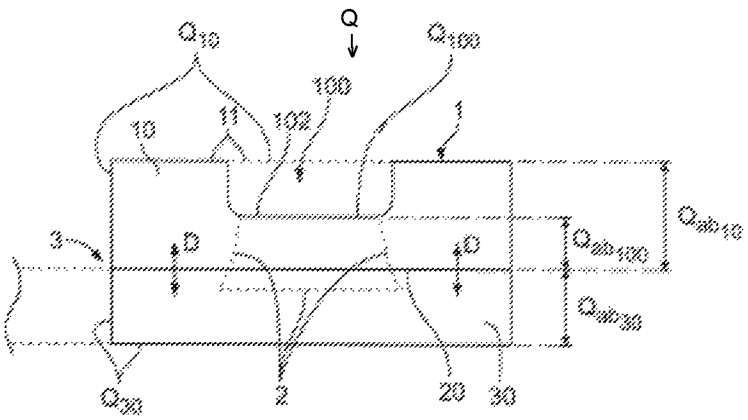
FIG. 2 is a sectional view of the contact of FIG. 1.

The contact 10, in the embodiment shown in FIGS. 1 and 2, is mirror-symmetrical, substantially in the form of a square, and has, in a longitudinal direction L of the contact 10, a substantially constant, rectangular surface cross-section Q10. In an embodiment, an overall cross-section Q of the contact 10 has the substantially constant surface cross-section Q10 in the longitudinal direction L, shown as the dashed surface 11 of the contact 10 in FIG. 2.

The contact 10 has at least one groove 100 extending into the contact 10. The groove 100 may be formed as a closed circular ring, as shown in the embodiment of FIG. 1, an ellipsoidal ring, a spiral, a triangular chain, a square chain, a rectangular chain, a polygonal chain, or other forms known to those with ordinary skill in the art. The groove 100 can be open or closed at one or a plurality of longitudinal ends, which can be realized, for example, by means of a section, an arc, a spiral or a combined longitudinal extent. A base of the groove 100 can be flat as shown in the embodiment of FIG. 2. In other embodiments, the groove 100 can be irregular.

The groove 100 may be formed by means of a forming or re-forming method. In an embodiment, the groove 100 is formed by re-forming or ductile shaping in which metals or metal alloys are brought in a targeted manner into a different form with plastic deformation. During re-forming, by way of example, a raw material or workpiece which has been subjected to primary forming or has already been re-formed or formed in another way is, if appropriate, only partially re-formed plastically, wherein the raw material or workpiece substantially maintains its mass and its cohesion. A relevant mass of the raw material or workpiece is merely moved during re-forming. Re-forming differs from deformation in that a change in shape is achieved in a targeted manner. The groove 100 may be re-formed by stamping or another cavity-forming In another embodiment shown in FIG. 2, the overall cross-section Q of the contact 10 incorporates the groove 100, the overall cross-section Q changing in the longitudinal direction L from the surface cross-section Q10 in sections where there is no groove 100 to the comparatively small groove cross-section Q100 in sections where the groove 100 is provided. The groove cross-section Q100 is the cross-section of the contact 10 in the region of the groove 100. The groove cross-section Q100 can also change in the longitudinal direction L.

The groove 100, as shown in FIG. 2, is disposed in a surface 11 of the contact 10. The base of the groove 100 is within the contact 10 and is accessible through an opening in the groove 100, for example, by a laser beam or a welding tool of a welding apparatus. During welding, a welded connection 2 region beneath and to the side of the groove 100 fuses with the mating contact 30. The contact 10 and the mating contact 30 are thus fixedly held together so as to form a contact region 20 for the electric current to pass between the contact 10 and the mating contact 30. A flow of the electric current through the contact region 20 is illustrated by the double arrows D in FIG. 2. The contact 10 is only welded to the mating contact 30 in the region of the groove 100.

After the welding, a weld seam 102 shown in FIG. 2 is produced at the base of the groove 100. The weld seam 102 is substantially similar to the groove 100. The weld seam 102 can have a plurality of welding sections, with each welding section being linear, angular and/or bent; closed, open and/or flat; and/or singular and/or combined. The weld seam 102 can have one or a plurality of welding spots.

A side of the mating contact 30 which has a comparatively large area is positioned to correspond to the side of the contact 10 which has a comparatively large area. The surface cross-section Q10 of the contact 10 is laser-welded to a mating cross-section Q30 of the mating contact 30. The cross-sectional area Q10 of the contact 10 can in this case be smaller, substantially equal in size to or larger than the cross-sectional area Q30 of the mating contact 30.

As shown in FIG. 2, the welded connection 2 is formed over a welded cross-sectional thickness Qab100 of the contact 10 in the region of the groove 100 and of a directly adjoining region of the mating contact 30. The cross-sectional dimension Qab100 is a comparatively small cross-sectional dimension Qab100 of the contact 10. The welded cross-sectional thickness Qab 100 may be approximately 0.7 mm to approximately 1.9 mm, approximately 0.75 mm to approximately 1.7 mm, approximately 0.85 to approximately 1.5 mm, or approximately 0.95 mm to approximately 1.25 mm.

The surface cross-section Q10 of the contact 10 has a surface cross-sectional thickness Qab10 outside the groove 100. The cross-sectional dimension Qab10 is a comparatively large cross-sectional dimension of the contact 10. The mating contact 30 has a mating cross-sectional thickness Qab30 which is consistent across the longitudinal direction L of the mating contact 30.

A ratio of the mating cross-sectional thickness Qab30 to the welded cross-sectional thickness Qab100 is 1.5 (+/−0.25): 1. The ratio may alternatively be approximately 1:1.35 to approximately 1:1.65 or approximately 1:1.45 to approximately 1:1.55. Other ratios can of course be used. In an embodiment, the surface cross-sectional area Q10 is larger than the mating cross-sectional area Q30. The surface cross-sectional area Q10 can also be substantially equal in size to or smaller than the mating cross-sectional area Q30.

Figure 3:
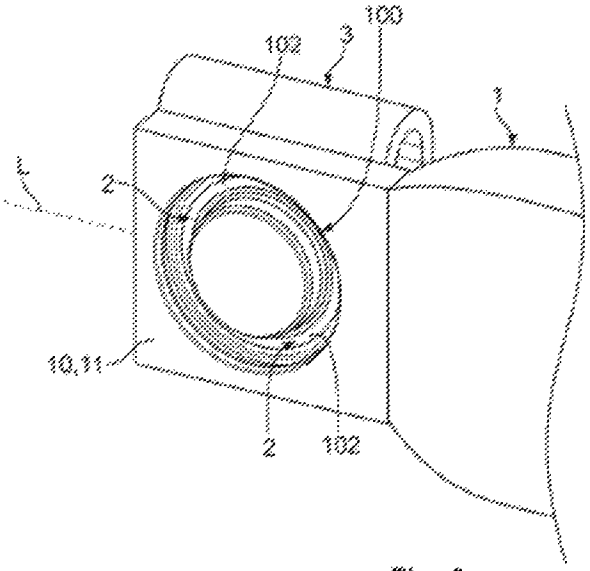
FIG. 3 is a perspective view of a contact of another electrical connector according to the invention.
Figure 4:
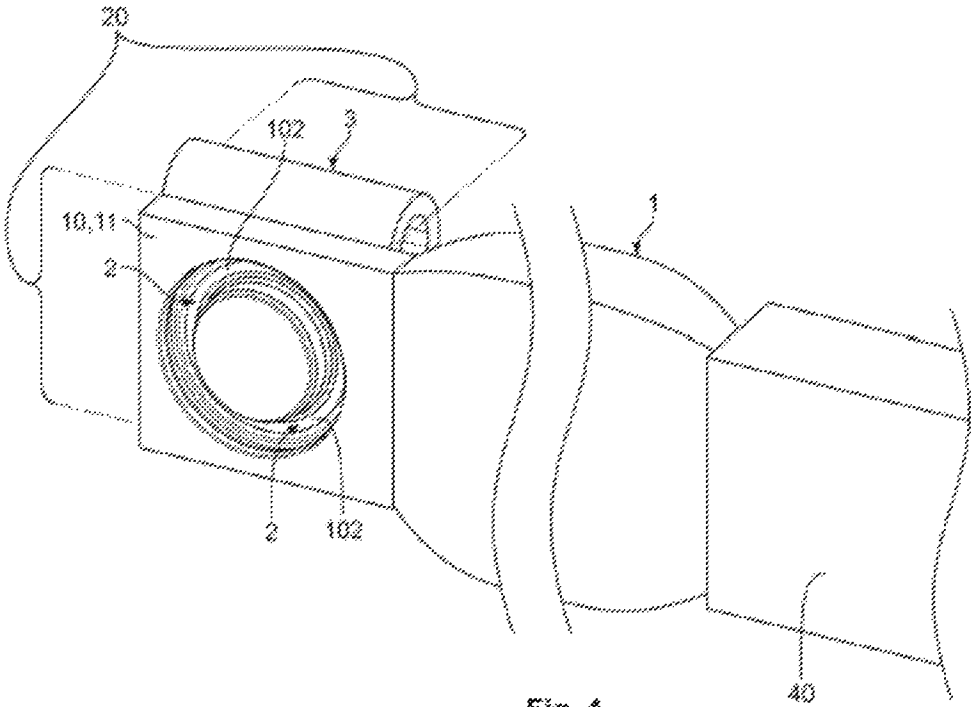
FIG. 4 is a perspective view of the electrical connector of FIG. 3 connected to a connector device.

In another embodiment, the electrical connector 1 may be a braided wire 1, as shown in FIGS. 3 and 4. The contact 10 is formed on at least one longitudinal end section of the braided wire 1. The groove 100 is established during compacting of the braided wire 1 to form the contact 10, but can also be introduced thereafter. After the compacting with re-forming to form the contact 10 with the groove 100 or after the introduction of the groove 100 into the contact 10, the braided wire 1 with the contact 10 can be welded via the groove 100 to the mating contact 30. FIG. 4 shows the braided wire 1 of FIG. 3 with an electrical connector device 40 positioned opposite the contact 10. The connector device 40 can be in the form of, for example, a plug-type connector, a female connector, a tab connector, a pin connector or a hybrid connector, a built-in male connector, a built-in female connector, a floating clutch, or other forms of connectors known to those with ordinary skill in the art. Instead of the connector device 40 illustrated in FIG. 4, the connector 1 according to the invention can of course be connected to an electrical contact in a different way. This can take place in a detachable or non-detachable form. The detachable form may be, for example, screwing or latching, and the non-detachable form may be riveting, welding, soldering or adhesive bonding.

Figure 5:
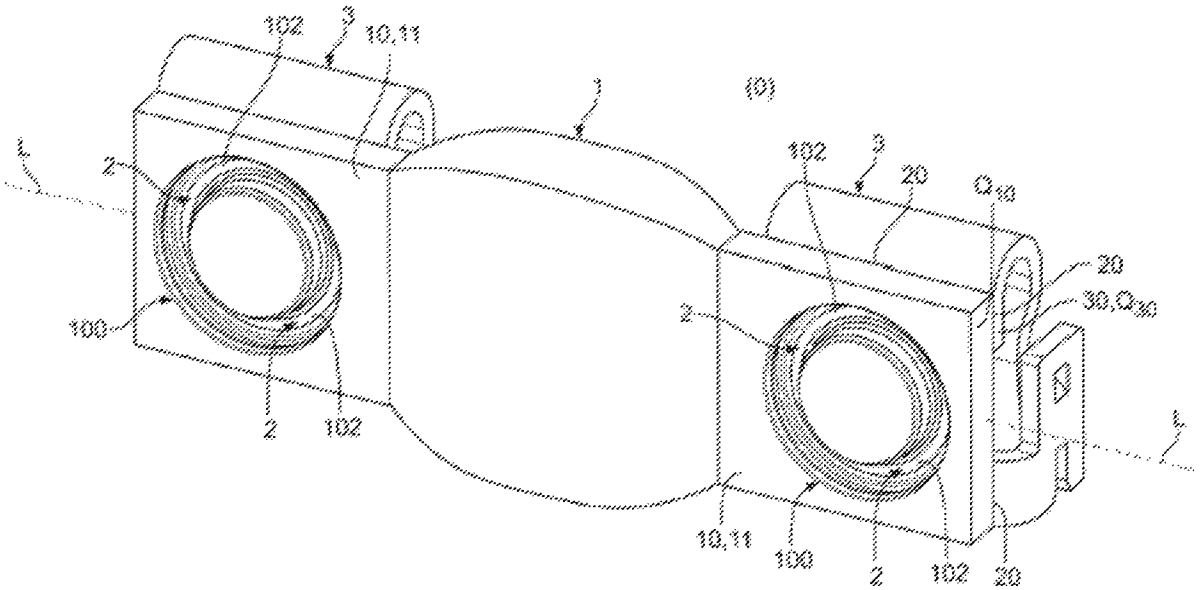
FIG. 5 is a perspective view of another electrical connector according to the invention.

In another embodiment, the electrical connector 1 may be a braided module connector 1, as shown in FIG. 5. The contacts 10 are formed on both longitudinal end sections of the braided module connector 1. The groove 100 is established during compacting of the braided wire of the braided module connector 1 to form the contact 10, but can also be introduced thereafter. The module connector 1 may be part of a battery or rechargeable battery 0. The battery or rechargeable battery 0 may be a traction battery/rechargeable battery, a drive battery/rechargeable battery, a cycle battery/rechargeable battery or a module thereof, an inverter, or a switchgear assembly 0. A first contact 10 is welded to a contact 30 of a connector 3 of a first module of the battery 0, and a second contact 10 is welded to a contact 30 of a connector 3 of a second module of the battery 0. The braided wire, which is formed integrally with the contacts 10 and to which the contacts 10 belong, extends between the two contacts 10.

In an embodiment of the module connector 1 of FIG. 5, due to a cross-sectional thickness Qab30 of the contacts 30, an injection depth for the laser in the groove 100 is reduced to approximately 0.8-1.2 mm (+/−0.05 mm) or to 0.9-1.1 mm (+/−0.05 mm). Other cross-sectional thicknesses Qab30 of a mating contact 30 can of course require other cross-sectional thicknesses Qab100 of the groove 100; the groove 100 is used for achieving a thickness ratio Qab100 : Qab30 described above between the contact 10 and the mating contact 30 which is suitable for welding.

The connector 1, as shown in FIG. 5, may also be part of any other electrical device 0, such as an electrical apparatus, an electrical module, an electrical appliance, electrical equipment, an installation, a system, or other electrical devices known to those with ordinary skill in the art and used for the automotive sector or a non-automotive sector. The connector 1 according to the invention is suitable, for example, for a busbar 0, such as a conductor bar, a distribution board, or a busbar distribution system.

In the embodiments shown in FIGS. 1-5, at least one outer edge of the contact 10 is substantially aligned with a relevant outer edge of the mating contact 30. This can apply to two, three or four outer edges of the contact 10. Further, it is possible to provide the groove 100 on an outer edge of the contact 10, wherein the groove 100 can extend along the outer edge and thus be formed so as to be open at least in sections on the longitudinal side. The groove 100 can be provided on one, two, three or four outer edges of the contact 10.

In the shown embodiments, the groove 100 has a cross-sectional profile with side walls parallel to one another, wherein a side wall can be arranged perpendicularly with respect to the base of the groove 100. In other embodiments, for a laser beam for welding which is not incident perpendicularly on the contact 10, it may be advantageous to provide an inner side wall with a slope. Energy from the laser beam can then penetrate during welding into radially outer regions of the contact 10 and the mating contact 30, enlarging the region of the welded connection 2.

In the shown embodiments, the cross-sectional profile of the groove 100 has a substantially identical cross-section at all points in a U form, a V form or a mixed form. A plurality of cross-sectional forms may also be provided in the groove 100. The base of the groove 100 can be provided parallel to a large-area outer side of the contact 10 or at an angle thereto. Such a base can be combined with an above-mentioned side wall of the groove 100. Furthermore, both the base and one or both side walls of the groove 100 can be flat or curved and/or rough or smooth.

Advantageously, in the electrical connector 1 according to the embodiments of the invention, by welding only in the region of the groove 100, the contact 10 can be welded to the already fitted mating contact 30 which is slightly thinner, the same thickness, or even slightly thicker than the contact 10. An electrical resistance is not influenced, and the mechanical cohesion owing to the welded connection 2 is still sufficiently high. Additionally, the welded connection 2 has no thermal disadvantages.

What is claimed is:

1. An electrical welded connection for use in a medium-current or high-current range, comprising:

an electrical connector having an electrical contact including a surface cross-sectional thickness between a first surface and an opposite second surface of the electrical contact and a groove formed in the first surface having a welded cross-sectional thickness between a base of the groove and the second surface less than the surface cross-sectional thickness; and a mating electrical connector, the second surface of the electrical contact welded to the mating electrical connector only in a welded region adjacent the groove, the welded region extending from the base of the groove and through the second surface of the electrical contact into a mating contact of the mating electrical connector.

2. The electrical welded connection of claim 1, wherein the electrical contact is a compacted section of the electrical connector.

3. The electrical welded connection of claim 1, wherein the groove is re-formed in the first surface of the electrical contact.

4. The electrical welded connection of claim 1, wherein the electrical connector is in the form of a braided wire, a braided cable, a litz wire cable, or a module connector.

5. The electrical welded connection of claim 1, wherein the mating contact has a mating cross-sectional thickness and a ratio of the mating cross sectional thickness to the welded cross-sectional thickness is between approximately 1.25:1 and 1.75:1.

6. The electrical welded connection of claim 1, wherein the welded cross-sectional thickness is between approximately 0.7 mm and 1.9 mm.

7. The electrical welded connection of claim 1, wherein the groove is positioned approximately centrally in the first surface between a pair of portions having the surface cross-sectional thickness.

8. The electrical welded connection of claim 1, wherein the base of the groove is parallel to the second surface of the electrical contact.

9. The electrical welded connection of claim 8, wherein the groove has a pair of side walls disposed on opposite sides of the base, the sides walls are parallel to one another and perpendicular to the base.

10. The electrical welded connection of claim 9, wherein a portion of the groove at which the base is connected to each side wall is curved.

11. The electrical welded connection of claim 1, wherein the groove has a U-shaped or a V-shaped cross-section.

12. A method for producing an electrical welded connection for use in a medium-current or high-current range, comprising:

providing a contact of an electrical connector having a first surface and an opposite second surface;

re-forming a groove into the first surface of the contact; and welding the second surface of the contact to a mating contact of a mating electrical connector only in a welded region adjacent the groove, the welded region extending from a base of the groove and through the second surface of the electrical contact into the mating contact.

13. The method of claim 12, wherein, in the welding step, a laser beam or welding tool is moved onto the base of the groove and a welded connection is established in the welded region adjacent the groove between the contact and the mating contact.

14. The method of claim 13, wherein the laser beam is incident in only one direction on the groove to form the welded connection.

15. The method of claim 14, wherein the laser beam is incident in a direction perpendicular to the first surface and the second surface.

16. The method of claim 12, wherein the contact has a surface cross-sectional thickness between the first surface and the second surface and the groove has a welded cross-sectional thickness between uthe base of the groove and the second surface less than the surface cross-sectional thickness.

17. The method of claim 12, wherein the electrical connector is an electrical cable.

18. The method of claim 17, further comprising compacting a section of the cable to form the contact.

19. The method of claim 18, wherein the re-forming step introduces the groove into the first surface of the contact during the compacting step.

* * * * *